US005411245A

United States Patent [19]

Springer et al.

[11] Patent Number: 5,411,245

[45] Date of Patent: May 2, 1995

[54] FOLDING APPARATUS WITH ROTATING VACUUM ROLLER

[75] Inventors: Johannes Springer, Heidelberg; Volker Wickenheisser, Reilingen, both of Germany

[73] Assignee: Heidelberger Druckmaschinen AG, Heidelberg, Germany

[21] Appl. No.: 70,542

[22] Filed: Jun. 1, 1993

[30] Foreign Application Priority Data

May 29, 1992 [DE] Germany ..... 42 17 814.2

[51] Int. Cl.[6] ..... B41F 13/56

[52] U.S. Cl. ..... 270/20.1; 493/432

[58] Field of Search ..... 270/4, 6, 10, 13, 19, 270/20.1, 32, 47, 48, 49, 50; 493/424–432

[56] References Cited

U.S. PATENT DOCUMENTS

| | | | |
|---|---|---|---|
| 3,689,061 | 9/1972 | Nystrand | 493/429 X |
| 4,349,185 | 9/1982 | Small et al. | 270/32 |
| 4,474,367 | 10/1984 | Jongerling et al. . | |
| 4,494,949 | 1/1985 | Baley | 493/432 |
| 4,521,209 | 6/1985 | DuFresne | 493/432 |
| 4,605,212 | 8/1986 | Kobler . | |
| 4,666,139 | 5/1987 | Filewich | 270/54 |
| 4,817,932 | 4/1989 | Stäb . | |
| 4,921,235 | 5/1990 | Biagiotti et al. | 270/47 |
| 5,013,020 | 5/1991 | Stoll | 270/49 |
| 5,039,076 | 8/1991 | Fischer | 270/47 |

FOREIGN PATENT DOCUMENTS

| | | |
|---|---|---|
| 0220644 | 6/1991 | European Pat. Off. . |
| 3427559 | 8/1986 | Germany . |
| 8809285 | 10/1988 | Germany . |
| 3705195 | 4/1989 | Germany . |
| 62-161680 | 7/1987 | Japan . |
| 2-81870 | 3/1990 | Japan . |

*Primary Examiner*—Edward K. Look
*Assistant Examiner*—John Ryznic
*Attorney, Agent, or Firm*—Herbert L. Lerner; Laurence A. Greenberg

[57] ABSTRACT

A device for guiding signatures between signature-guiding cylinders in a folding apparatus of a rotary printing press includes a guide member extending over the length of the signature-guiding cylinders for receiving signatures thereon, the guide member being disposed relative to the signature-guiding cylinders so as to facilitate a reversal of transport direction of the signatures, a support member whereon the guide member is rotatably supported, at least one conveyor belt for driving the guide member, and a device for applying negative pressure, during rotation of the guide member, to peripheral regions of the guide member and between the guide member and a respective signature received thereon.

10 Claims, 4 Drawing Sheets

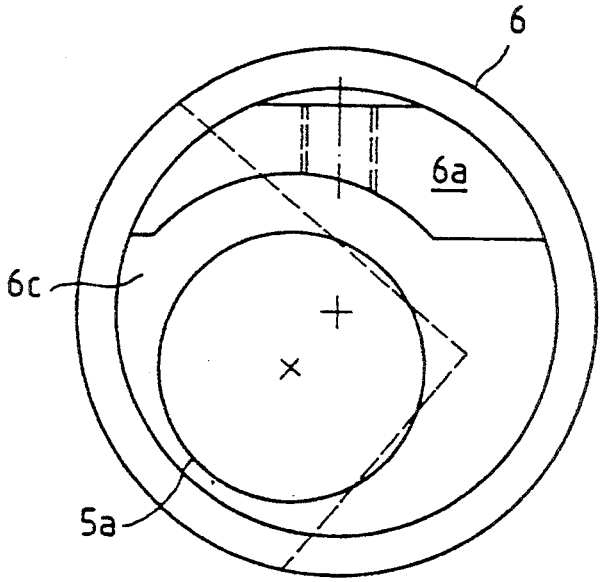
Fig. 1
Fig. 2
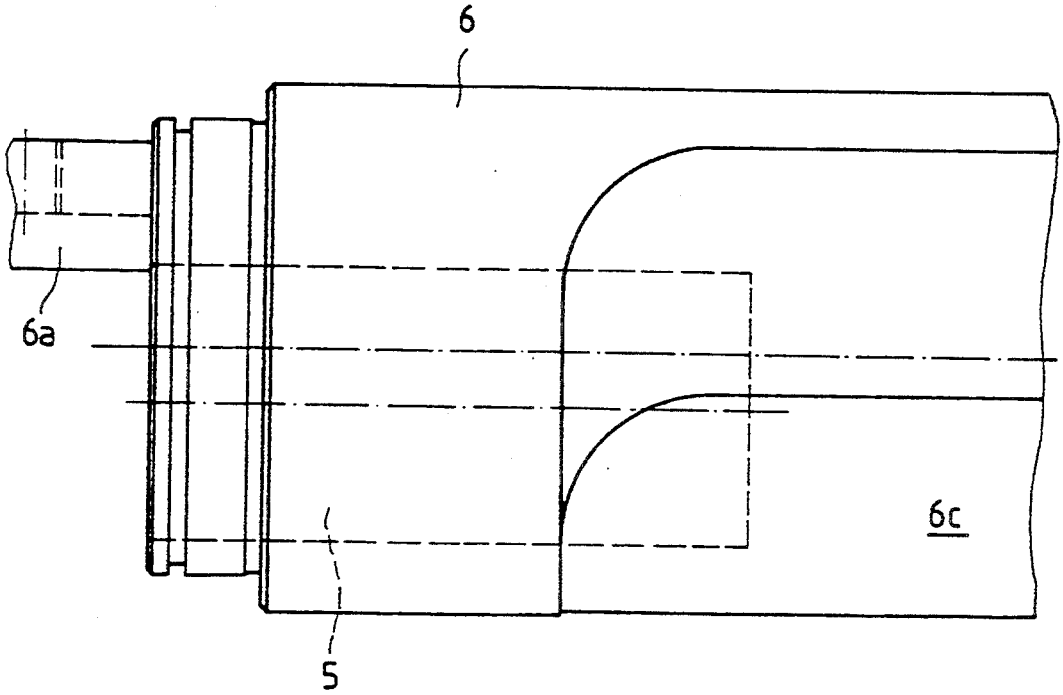

FOLDING APPARATUS WITH ROTATING VACUUM ROLLER

SPECIFICATION

The invention relates to a device for assisting controlled transport of signatures in a folding apparatus of a rotary printing machine and, more particularly, with regard to a reversal of transport direction of signatures on signature-guiding cylinders.

The published German Patent Document 88 09285.2 U1, wherein a stationary suction chamber is described which extends over the length of a cylinder, discloses a tape roller which is disposed in a nip between a pair of folding cylinders. A disadvantage of this arrangement is that two mutually separated components are provided therein for effecting a deflection or reversal and for applying suction. Because high accelerations occur during transfer of signatures from the chopper or tucker blade cylinder to the folding jaw cylinder, velocities result therefrom at which smudging or set-off of the signatures on stationary components, such as a suction chamber in the case described, cannot be avoided.

From the published European Patent Document 0220 644 B1, a device for vacuum-applied guidance of signatures. At a passage formed by a gap between a chopper-blade cylinder and a folding-jaw cylinder, the signatures are thrust into the folding jaws by the chopper blades. With a further rotation of the folding-jaw cylinder by which the signatures are gripped, the latter are drawn over a freely rotatable roller to which suction air is applied. Because the latter roller is not a driven roller, a movement in common of the signature which is to be stripped off and the roller to which suction air is applied is achieved only by friction contact or locking. The friction lock or contact between a freshly printed signature surface and the casing or jacket of the roller to which suction air is applied can cause smudging or smearing of the printed product and the set-off or deposit of ink on the jacket of the roller. Guide or deflector plates arranged on both sides of the freely rotatable roller, furthermore, produce high relative velocities between the signature which is to be stripped off and the outer cylindrical surface of the respective roller, which is also disadvantageous for a gentle and careful treatment of the surfaces of the signature.

It is accordingly an object of the invention to provide a device for assisting a controlled transport of signatures in a folding apparatus of a rotary printing machine which, in a further development of the state of the art, is optimized so as to ensure that signature transport will always be achievable even at yet to be increased processing speeds.

With the foregoing and other objects in view, there is provided, in accordance with the invention, in a folding apparatus of a rotary printing press, a device for guiding signatures between signature-guiding cylinders, comprising guide means extending over the length of the signature-guiding cylinders for receiving signatures thereon, the guide means being disposed relative to the signature-guiding cylinders so as to facilitate a reversal of transport direction of the signatures, support means whereon the guide means are rotatably supported, at least one conveyor belt for driving the guide means, and means for applying negative pressure, during rotation of the guide means, to peripheral regions of the guide means and between the guide means and a respective signature received thereon.

Due to the foregoing construction of the device according to the invention, advantages in many respects are achievable. Inasmuch as the peripheral speed of the cylinders exists as well at the periphery or circumference of the guide means due to the means, namely the conveyor belt, for driving the guide means, differences in speeds between the signature and the guide means are avoided. Thus, smearing of ink does not occur. During the rotation of the guide means, a circumferential or peripheral region of the guide means always has negative pressure or vacuum applied thereto, so that a signature to be pulled from a signature-guiding cylinder can be guided continually over the entire signature length.

So-called dog ears or corner fold-overs can thereby be avoided, and uncontrolled movements of the signature on its own during the transport thereof do not occur. After the signatures have left the range of operation of the negative pressure or vacuum, they are received between off-running strands of the conveyor belts and the surface of a folding-jaw cylinder. Because no differences in speed occur likewise in this transport section between the signature and the contact surfaces of the off-running strand, on the one hand, as well as between the signature and the outer cylindrical casing surface of the folding-jaw cylinder, on the other hand, a controlled product handling or management is always assured in this critical transport section during the reversal in transport direction.

In accordance with another feature of the invention, the guide means are constructed as a suction roller casing.

In accordance with a further feature of the invention, the suction roller casing is formed with a plurality of bores disposed in at least one annular arrangement thereon.

In accordance with an alternate feature of the invention, at least another annular arrangement of a plurality of bores is formed in the suction roller casing, and a bearing surface for a conveyor belt is provided, the bearing surface being formed on the suction roller casing between the annular arrangements of pluralities of bores.

In accordance with an additional alternate feature of the invention, at least two additional annular arrangements of respective pluralities of bores are formed in the suction roller casing, and respective bearing surfaces are provided for respective conveyor belts, the bearing surfaces, respectively, being formed on the suction roller casing between respective pairs of the annular arrangements of pluralities of bores.

Because the bores are formed in the thickened regions of the suction roller casing, the latter meets and accommodates the mechanical stresses for a relatively small mass. Further provided are bearing surfaces for conveyor belts, the bearing surfaces, respectively, being disposed between adjacent annular arrangements of pluralities of the bores. By means of the conveyor belts running on the bearing surfaces, the drive for the suction roller casing is effected with a peripheral speed like that of the cylinders for the purpose of eliminating differences in speed. Furthermore, the signatures guided on the circumference or periphery of the suction roller casing are directly taken up or received from off-running strands of the conveyor belts.

In accordance with yet another feature of the invention, the support means comprise a suction roller shaft having a vacuum chamber formed therein.

In accordance with yet a further feature of the invention, a negative pressure source having a regulatable suction-air rate flow is connected to the vacuum chamber, in order to ensure a correct and reliable engagement of the individual signatures on and with the peripheral or circumferential surface of the suction roller casing.

In accordance with yet an added feature of the invention, means in the form of at least one rod are provided for separating the vacuum chamber into at least two partial chambers. Thus, when processing web lengths having only half the conventional width thereof, this feature permits the application, for example, of only half of the vacuum chamber with negative pressure or vacuum. With a possibility of moving the rod in axial direction in the interior of the vacuum chamber, the axial operating range can be matched or adjusted to varying demands or requirements.

In accordance with yet an additional feature of the invention, the signature-guiding device includes means for varying the diameter of the bearing surface formed on the suction roller casing for effecting a phase lead and a phase lag, respectively, of the suction roller casing relative to the peripheral speed of the signature-guiding cylinders.

In accordance with a concomitant feature of the invention, the means for varying the diameter of the bearing surface comprise an elastic ring mountable on the bearing surface. The adjustment for effecting a phase lead or a phase lag of the suction roller casing relative to the peripheral speed of the signature-guiding cylinders can be of importance especially for the processing of heavy or thick signatures formed from several web lengths which have been joined together.

Other features which are considered as characteristic for the invention are set forth in the appended claims.

Although the invention is illustrated and described herein as embodied in a device for assisting a controlled transport of signatures in a folding apparatus of a rotary printing machine, it is not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is an end view of a suction roller shaft constructed in accordance with the invention;

FIG. 2 is a fragmentary front elevational view of FIG. 1;

Figure 3:
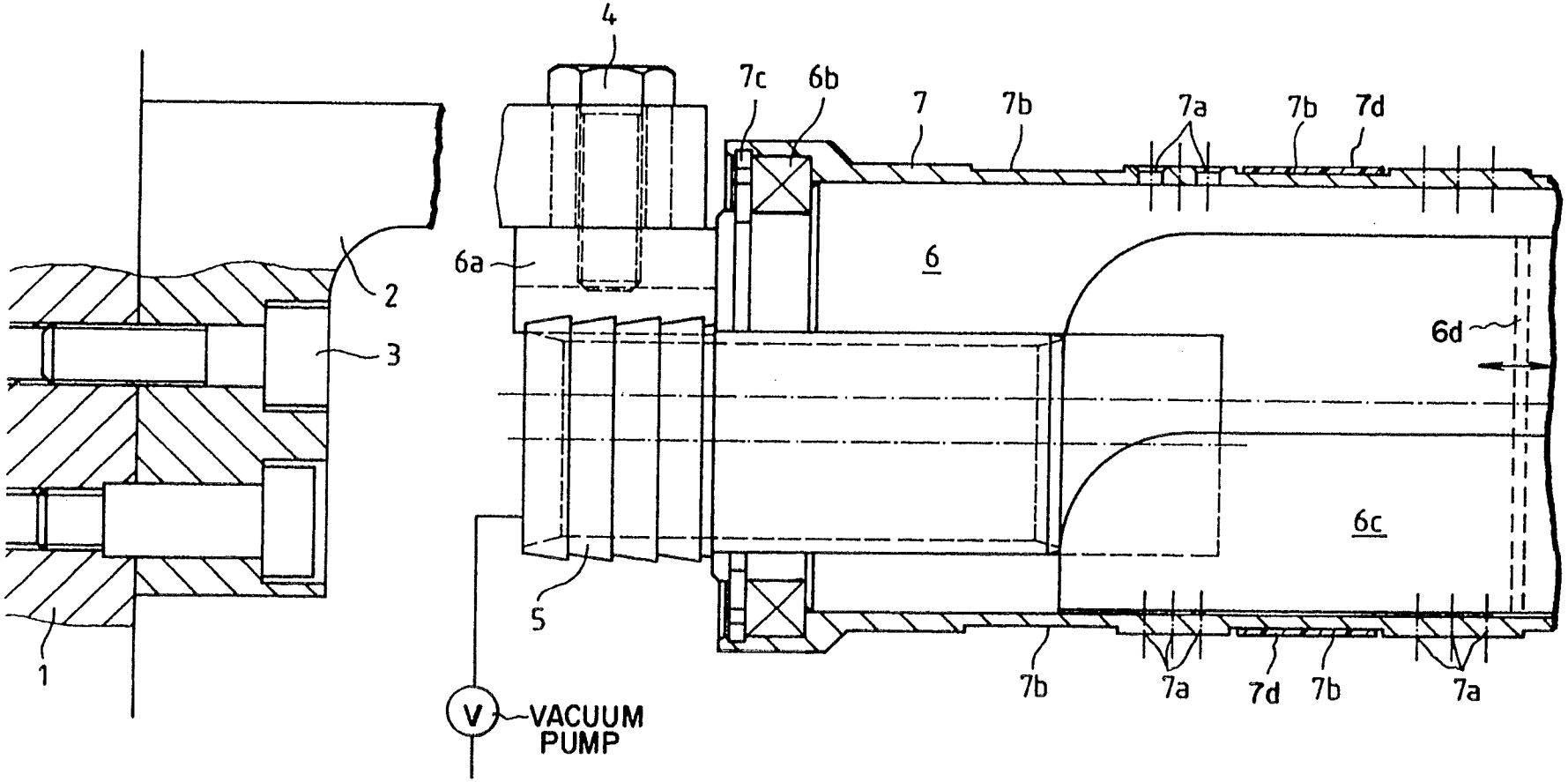
FIG. 3 is a longitudinal sectional view, partly broken away, of FIG. 2, showing the suction roller shaft together with a vacuum chamber, as well as the suction roller jacket.

Referring now to the drawings and, first, particularly to FIG. 1 thereof, a suction roller shaft 6 is shown therein, in a side or end view. The suction roller shaft 6 is formed with a vacuum chamber 6*c* defined, as indicated, by broken lines. A nozzle or union-receiving opening 5*a* is formed in a side or end face of the suction roller shaft 6. A receiving member 6*a* is disposed above the union-receiving opening 5*a* and is received together with the suction roller shaft 6 in a suitable holder or mounting support 2 (FIG. 3).

FIG. 2 is a fragmentary front elevational view of the suction roller shaft 6. As is apparent from this view, the union-receiving opening 5*a* extends to the vacuum chamber 6*c*. The illustrated end-region structure defining the union-receiving opening 5*a*, in cooperation with a suction roller casing 7 (note FIG. 3), serves as a gap or nip seal for sealing the vacuum chamber 6*c*. Therefore, co-rotating sealing elements which are prone towards wear and soiling can be dispensed with at the boundaries of the vacuum chamber 6*c*.

A cross-sectional view of the suction roller casing 7 and the suction roller shaft 6, together with the vacuum chamber 6*c*, is presented in FIG. 3. The holder or mounting support 2 is secured by bolts or screws 3 in a boundary wall 1. A stop screw 4 is threadedly secured in the mounting support 2 and is further screwed into a thread formed in the receiving member 6*a*. The receiving member 6*a* is formed with a concave recess which facilitates placement of a suction air line onto an air connection or union 5. The air connection 5 is received in the union-receiving opening 5*a* of the suction roller shaft 6 and connects a negative-pressure or vacuum source having a regulatable air flow rate to the vacuum chamber 6*c*. A bearing 6*b* is further provided on the suction roller shaft 6 for rotatably supporting the suction roller casing 7 on the suction roller shaft 6. The bearing 6*b* is axially secured by guard or retaining rings. The suction roller casing 7 is formed circumferentially with depressions defining annular bearing surfaces 7*b*, as well as with annular thickened regions wherein bores 7*a* are formed. As is readily apparent from FIG. 3, the thickened regions and the depressions are disposed at the outer circumferential surface of the suction roller casing 7 in alternating succession, respectively, in axial direction thereof. Conveyor tapes or belts 12*a* (FIG. 4) revolve in the depressions forming the bearing surfaces 7*b* in the circumferential or peripheral surface of the suction roller casing 7, and set the suction roller casing 7 in rotation relative to the suction roller shaft 6. Because the suction roller shaft 6 and the suction roller casing 7 have a very slender structure, a rapid build-up of vacuum or negative pressure in the vacuum chamber 6*c* at the individual bores 7*a* formed in the suction roller casing 7 is assured.

Within the limits of an automatic pre-adjustment to the width of a web which is to be processed, it is possible to support wall 6*d* formed of synthetic material and having dimensions corresponding to those of the vacuum-chamber contour or shape on a threaded spindle extending through the vacuum chamber. Moreover, wall, which is a means for separating the vacuum chamber into at least two partial chambers can be driven in axial direction by a remotely controllable adjusting motor, so that, due to the position of the wall 6d, only one region of the vacuum chamber 6c is subjectible to negative pressure or vacuum. Thus, the distribution of negative pressure at the suction roller casing 7 within the limits of the pre-adjustment at the folding apparatus is matched to the format of the material to be printed on, which is to be processed. Elastic rings 7d may be mounted on the bearing surface 7b. The elastic rings 7d are means for varying the diameter of the bearing surface 7b.

Figure 4:
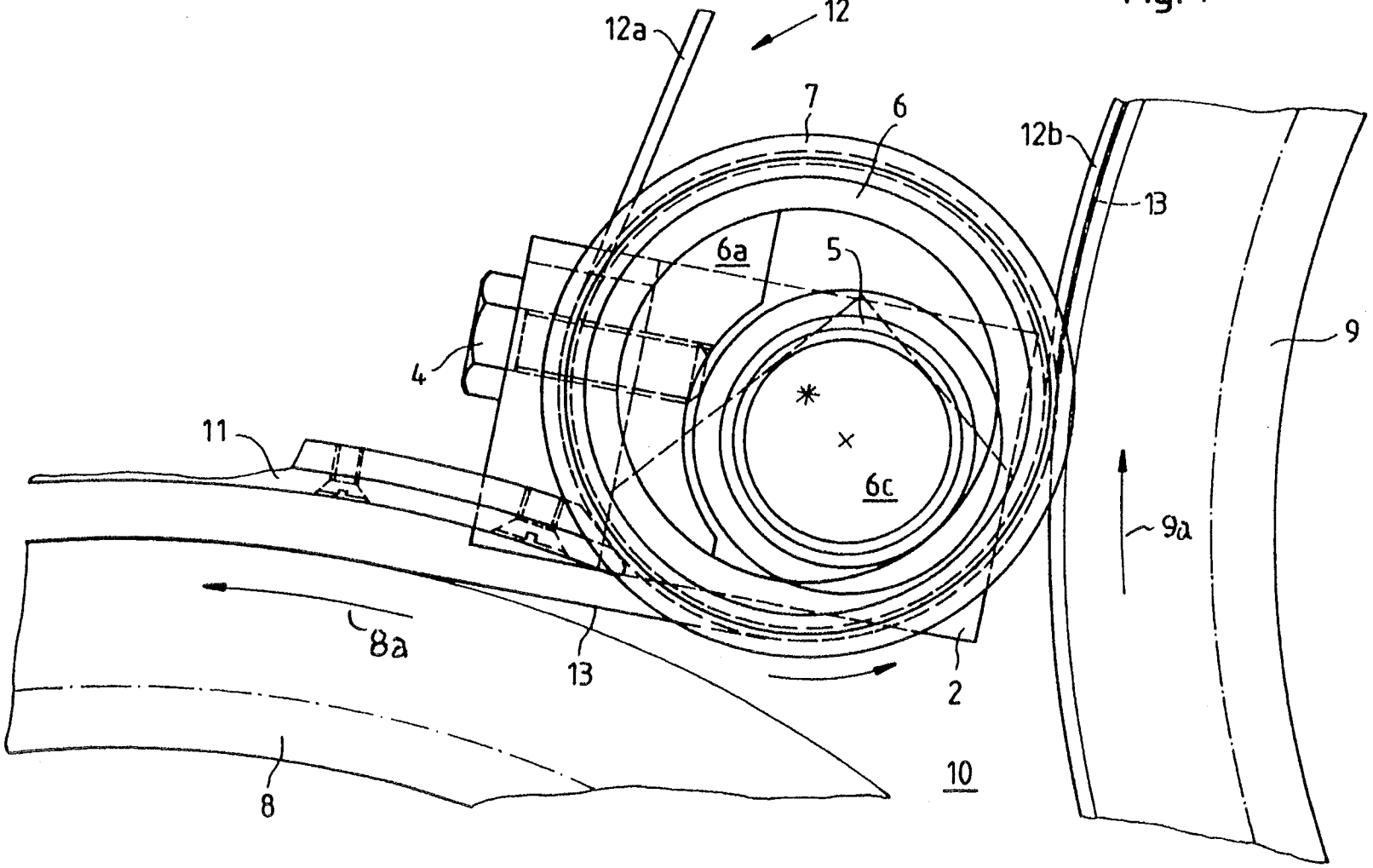
FIG. 4 is a view like that of FIG. 1 of the suction roller shaft in a different operating phase thereof, together with a suction roller jacket mounted thereon, and on-running and off-running strands of a conveyor tape or belt, the assembly being shown disposed at an installation location in a nip between a pair of signature-guiding cylinders.

FIG. 4 shows the installed position of the suction roller casing 7 on the suction roller shaft 6 with on and off-running conveyor-belt or conveyor-tape strands 12a and 12b, respectively, in a nip 10 between a pair of signature-guiding cylinders 8 and 9. The receiving member 6a of the suction roller shaft 6 is fastened by the stop screws 4 to the mounting support 2 which is secured to a side of the machine or printing-press wall. The vacuum chamber 6c is subjected to vacuum or negative pressure via the air connection 5. Conveyor belts or tapes 12 running in the depressions formed in the surface of the casing 7 of the suction roller shaft 6 and represented by broken lines in FIG. 4 set the suction roller casing 7 in rotation. The tight or pulling strand 12b of the respective conveyor belt or tape 12 introduces the drive for the suction roller shaft 6 in accordance with the peripheral speed of the signature-guiding cylinder 9; the pulling strand 12b of the conveyor belt or tape 12 lies on the surface of the signature-guiding cylinder 9 and conveys the signature 13.

Figure 5:
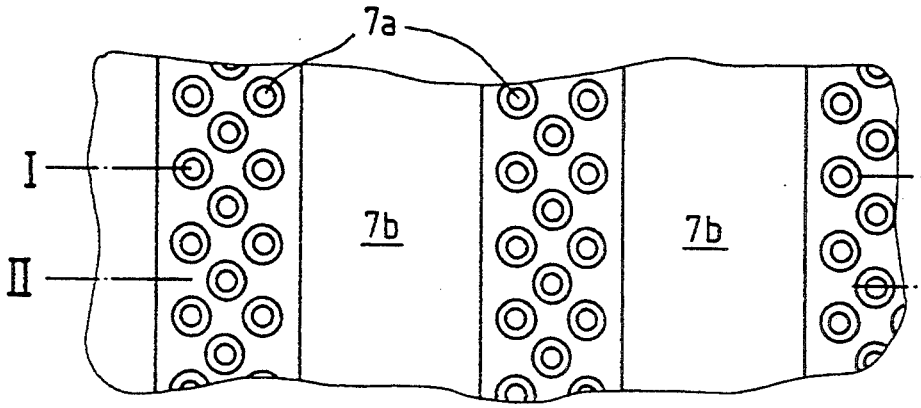
FIG. 5 is a fragmentary plan view of another embodiment of the suction roller jacket.
Figure 5A:
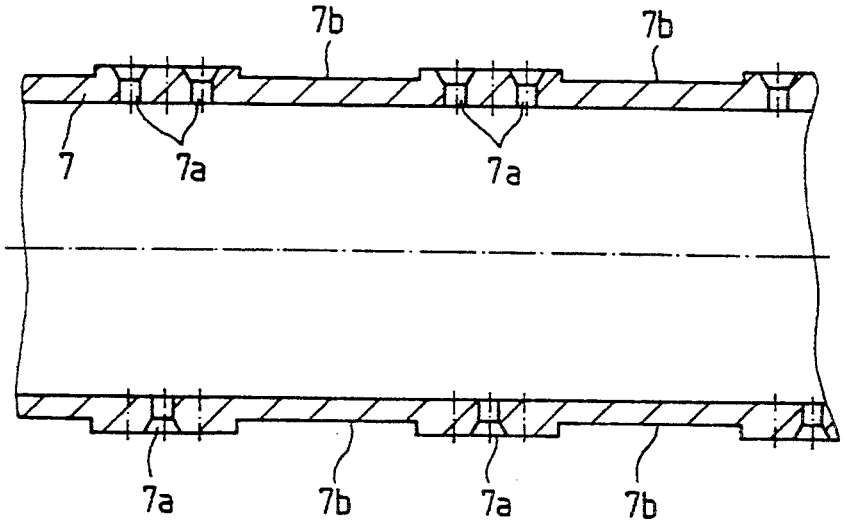
FIGS. 5*a* and 5*b* are respective longitudinal sectional and cross-sectional views of FIG. 5 taken along the lines Va—Va and Vb—Vb, respectively.

The signature 13 cut from a web strand formed also of several layers is taken up by the signature-guiding cylinder 8, i.e., a chopper blade cylinder, and conveyed in the direction of the arrow 8a associated with the cylinder 8 out of the cylinder nip 10. A non-illustrated chopper blade conventionally thrusts the signature, for example, at the middle thereof, into likewise non-illustrated conventional clamping jaws of the signature-guiding cylinder 9, i.e., a clamping jaw cylinder. From the signature-guiding or clamping jaw cylinder 9, the signature 13 is drawn off at a transfer location in a direction opposite to the original transport direction thereof represented by the arrow 8a associated with the signature-guiding cylinder 8, due to the rotation of the signature-guiding cylinder 9 in the direction of rotation thereof represented by the arrow 9a. Fluttering and turning or creasing of the corners of the signature 13, are avoided by the provision of a product guide 11 above the signature 13 which is to be pulled off. By applying vacuum or negative pressure to the vacuum chamber 6c in the suction roller shaft 6, suction is applied to the signature 13 gripped at the folding spline thereof by the signature-guiding cylinder 9. Because the suction roller casing 7 rotates at the circumferential or peripheral speed of the cylinders 8 and 9, differences in circumferential or peripheral speeds are eliminated. Inasmuch as the vacuum or negative pressure continually exists in the vacuum chamber 6c, and the signature 13 is transported by the rotating suction roller casing 7, the full length of the signature 13 is moved past the vacuum chamber 6c subjected to the vacuum or negative pressure and is thereby subjected to suction therefrom. After passage of the peripheral segment subjected to negative pressure or vacuum through the contour of the vacuum chamber 6c, the signatures 13 arrive between the surface of the signature-guiding cylinder 9 and the surfaces of the pulling strand 12b of the conveyor belts or tapes 12 facing towards the signatures 13. Because the belts or tapes 12 are moving at the same speed as that of the cylinder periphery, the signatures 13 are not subjected to any frictional or shear stresses. As is readily apparent from FIG. 4, the signatures 13 transported between the pulling strand 12b and the outer cylindrical surface of the signature-guiding cylinder 9 can then be processed further on the folding jaw cylinder. In this manner, in the reversal of transport direction of the signatures 13, the surfaces thereof undergo continual guidance during the transfer from one to the other of the signature-guiding cylinders 8 and 9 which permits signature processing to be performed at the very highest speed. FIGS. 5 and 5a show the suction roller casing 7 with bores 7a formed therein. The bores 7a are formed in annularly extending thickened sections on the suction roller casing 7 and are countersunk therein. Due to the mutually offset arrangement of the individual bores 7a, as shown in FIG. 5, a high distribution density of the annular thickened sections is attainable. Reliable application of suction to the signatures 13 even at high speeds is thereby assured.

Figure 5B:
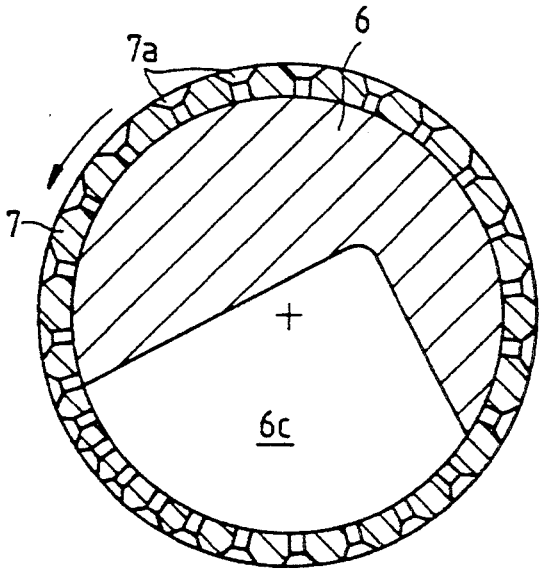

In FIG. 5b, the vacuum chamber 6c is shown in a cross-sectional view. The defining wall surface of the vacuum chamber 6c extending towards the left-hand side of FIG. 5b marks the beginning of the suction zone on the peripheral surface of the suction roller casing 7 rotating on the suction roller shaft 6. The defining wall surface of the vacuum chamber 6c extending towards the right-hand side of FIG. 5b marks the end of the suction zone on the peripheral surface of the suction roller casing 7 rotating on the suction roller shaft 6. By varying the location of the defining wall surfaces of the vacuum chamber 6c, the position of the suction zone on the peripheral surface of the suction roller casing 7 can be varied, so that individual requirements can be taken into consideration. In the instant positions of the vacuum chamber 6c and the suction roller casing 7 relative to one another, as illustrated in FIG. 5b, the lower bores 7a formed in the suction roller casing 7 are shown in contact with the vacuum chamber 6c, whereas the upper bores 7a are separated from the suction air source. A small gap is provided between the outer cylindrical surface of the suction roller shaft 6 and the inner cylindrical surface of the suction roller casing 7 in order to permit relatively easy rotation of the suction roller casing 7 with respect to the suction roller shaft 6. This gap is realized as a contact-free gap seal in the axial limiting region of the vacuum chamber 6c. Sealing of the vacuum chamber 6c can be achieved thereby, and any leakage losses remain negligible.

We claim:

1. In a folding apparatus of a rotary printing press, the folding apparatus having two mutually counter-rotating sheet-guiding cylinders between which signatures are transported and which form a nip therebetween, a device for facilitating a reversal of the transport direction of the signatures between the signature-guiding cylinders, comprising guide means extending over an axial length of the signature-guiding cylinders for receiving signatures thereon, said guide means being disposed in the nip formed by the signature-guiding cylinders so as to facilitate the reversal of the transport direction of the signatures, support means whereon said guide means are rotatably supported, at least one conveyor belt for driving said guide means, and means for applying negative pressure, during rotation of said guide means, to peripheral regions of said guide means and between said guide means and a respective signature received thereon.

2. Signature-guiding device according to claim 1, wherein said guide means are constructed as a suction roller casing.

3. Signature-guiding device according to claim 2, wherein said suction roller casing is formed with a plurality of bores disposed in at least one annular arrangement thereon.

4. Signature-guiding device according to claim 3, including at least another annular arrangement of a plurality of bores formed in said suction roller casing, and a bearing surface for a conveyor belt, said bearing surface being formed on said suction roller casing between said annular arrangements of pluralities of bores.

5. Signature-guiding device according to claim 3, including at least two additional annular arrangements of respective pluralities of bores formed in said suction roller casing, and respective bearing surfaces for respective conveyor belts, said bearing surfaces, respectively, being formed on said suction roller casing between respective pairs of said annular arrangements of pluralities of bores.

6. Signature-guiding device according to claim 1, wherein said support means comprise a suction roller shaft having a vacuum chamber formed therein.

7. Signature-guiding device according to claim 6, including a negative pressure source having a regulatable suction-air rate flow connected to said vacuum chamber.

8. Signature-guiding device according to claim 6, including means for separating the vacuum chamber into at least two partial chambers.

9. Signature-guiding device according to claim 4, including means for varying the diameter of said bearing surface formed on said suction roller casing for effecting a phase lead and a phase lag, respectively, of said suction roller casing relative to the peripheral speed of the signature-guiding cylinders.

10. Signature-guiding device according to claim 9, wherein said means for varying the diameter of said bearing surface comprise an elastic ring mountable on said bearing surface.

* * * * *